US005862882A

United States Patent [19]

Brady et al.

[11] Patent Number: 5,862,882

[45] Date of Patent: Jan. 26, 1999

[54] BALLISTIC ASSAULT LADDER AND SYSTEM FOR USE THEREOF

[76] Inventors: Ronald N. Brady, 20177 Joyner Rd., Covington, La. 70435; Geoffrey M. Mullin, 202 Dover Pl. Apt. 2, Stafford, Va. 22554

[21] Appl. No.: 988,774

[22] Filed: Dec. 11, 1997

[51] Int. Cl.[6] ..... F41H 5/08

[52] U.S. Cl. ..... 182/129; 89/36.05

[58] Field of Search ..... 182/129, 106, 182/230; 89/36.05, 36.07

[56] References Cited

U.S. PATENT DOCUMENTS

| | | | |
|---|---|---|---|
| 36,781 | 10/1862 | Hunter | 89/36.05 |
| 1,279,229 | 9/1918 | Bilan . | |
| 3,968,857 | 7/1976 | Bryan | 182/230 |
| 4,450,937 | 5/1984 | Broughton | 182/106 |
| 5,086,872 | 2/1992 | Lin | 182/20 |
| 5,392,686 | 2/1995 | Sankar | 89/36.05 |
| 5,441,126 | 8/1995 | Orrick | 182/230 |

*Primary Examiner*—Alvin Chin-Shue
*Attorney, Agent, or Firm*—Joseph J. Regard, LTD

[57] ABSTRACT

A ballistic assault ladder for utilization in counter-terrorism and hostage rescue activities and the like. The preferred embodiment of the present invention contemplates a ladder having a standard rung-type design, the ladder having first and second edges, a front face and a back face, the back face having situated about the supports of the ladder a spacer and engagement hardware configured to securely engage ballistic-resistant material, forming a shield which is spaced from the rungs of the ladder so as to allow a user to utilize the ladder as a shield in a hostile area while approaching a target, by holding the rungs from the front face, and utilize the ladder in a traditional fashion once the user has reached the target. The present invention also includes a method of approaching a hostile target utilizing the ballistic assault ladder of the present invention, wherein the user grasps the ladder in a designated fashion in a protective capacity while approaching a target, and utilizes said ladder in a designated fashion upon reaching the target. The preferred embodiment of the present invention further contemplates a port or window situated in the shield, the port or window also fabricated from a ballistic material.

7 Claims, 3 Drawing Sheets

BALLISTIC ASSAULT LADDER AND SYSTEM FOR USE THEREOF

TECHNICAL FIELD OF THE INVENTION

The present invention relates to shielding devices for preventing the penetration of projectiles therethrough for protecting a user, and in particular to a ballistic assault ladder for utilization in counter-terrorism and hostage rescue activities and the like.

The preferred embodiment of the present invention contemplates a ladder having a standard rung-type design, the ladder having first and second edges, a front face and a back face, the back face having situated about the supports of the ladder a spacer and engagement hardware configured to securely engage and support a Level IIIA ballistic material such as, for example, SPECTRA, KEVLAR, or the like, forming a flat, relatively shield which is spaced from the rungs of the ladder so as to allow a user to utilize the ladder as a shield in a hostile area while approaching a target, by holding the rungs from the front face, and utilize the ladder in a traditional fashion once the user has reached the target.

The present invention also includes a method of approaching a hostile target utilizing the ballistic assault ladder of the present invention, wherein the user grasps the ladder in a designated fashion in a protective capacity while approaching a target, and utilizes said ladder in a designated fashion upon reaching the target.

The preferred embodiment of the present invention further contemplates a port or window situated in the shield, the port or window also fabricated from a ballistic material such as Level IIIA ballistic material.

BACKGROUND OF THE INVENTION

While the prior art has contemplated a variety of shields, including projectile shields and guards to prevent the use of ladders, and riot shields, bullet proof vests, and flak jackets and the like, none appear to have contemplated or suggested the combination of the present invention.

A listing of some patents which may be considered pertinent to the present invention follow:

| Patent Number | Inventor | Issue Date |
|---|---|---|
| 4,579,197 | Spurling | 04/01/1986 |
| 4,674,394 | Martino | 01/23/1987 |
| 4,843,947 | Bauer et al | 07/04/1989 |
| 5,241,703 | Roberts et al | 09/07/1993 |

U.S. Pat. No. 4,579,197 teaches a ladder guard comprising a flat, planer surface adopted to engage one side of a fixed ladder in order to prevent unauthorized parties from climbing the ladder when in the closed, locked position.

U.S. Pat. No. 4,764,394 to Martino teaches a "Portable Bullet-Proof Shield" of ballistic material, the shield including a portal for viewing therethrough, also of bullet-proof material.

U.S. Pat. Nos. 5,241,703 and 5,641,934 contemplate transparent protective shields of bullet resistant material.

U.S. Pat. No. 4,843,941 teaches a riot shield, and is of general pertinence.

Approaching a hostile target is a difficult and dangerous operation for police, military, and the like. In the past, one had to rely upon a shield or other protective item placed between the target and the user, or the user was exposed to firepower. This problem was compounded when the user had to scale an obstacle such as a fence or vehicle, or had to gain access to a raised point of entry, such as a window, as the choice was either a ladder or a shield; without the shield, the user was exposed; without the ladder, the user faced problems in quickly scaling the obstacle.

Based upon a review of the above prior art, it would appear that the concept of a specially designed ladder configured for utilization in an offensive assault, further including a spaced shield separated therefrom of projectile resistant material has not been shown or suggested in combination in the prior art.

GENERAL SUMMARY DISCUSSION OF THE INVENTION

Unlike the prior art, the present invention contemplates a ballistic shield incorporating the attributes of a ladder which provides a relatively easily implemented, effective, and safer alternative than the devices and systems contemplated in the prior art.

Special Weapons and Tactics (SWAT) teams have been implemented in large and small cities alike throughout the world, in response to terrorism and criminal threats. One of the more dangerous and difficult situations involving these teams is the approach to an area which may include armed parties, which area may be raised.

The present invention is configured to provide a dual purpose in such a situation, that is, a shield for the approach, protecting the user from projectiles fired in the direction of the user, while providing a means to quickly and quietly scale any obstacles which the user may encounter to the target. The device of the present invention is specifically designed for this situation, and further includes padding for added stealth and gripping.

The preferred embodiment of the present invention contemplates a ladder having a standard rung-type design, the ladder having first and second edges, a front face and a back face, the back face having situated about the supports of the ladder a spacer and engagement hardware configured to securely engage and support a Level IIIA ballistic material such as, for example, SPECTRA, KEVLAR, or the like, forming a flat, relatively shield which is spaced from the rungs of the ladder so as to allow a user to utilize the ladder as a shield in a hostile area while approaching a target, by holding the rungs from the front face, and utilize the ladder in a traditional fashion once the user has reached the target.

The present invention also includes a method of approaching a hostile target utilizing the ballistic assault ladder of the present invention, wherein the user grasps the ladder in a designated fashion, providing a protective capacity while approaching a target, the approach itself utilizing known tactical methods, and utilizing said ladder in a designated fashion upon reaching the target.

The preferred embodiment of the present invention further contemplates a port or window situated in the shield, the port or window also fabricated from a ballistic material such as Level IIIA ballistic material.

It is therefore an object to provide a ladder which is optimally configured to be utilized in an offensive assault upon raised a target area.

It is another object of the present invention to provide a ballistic assault ladder which is easily implemented, carried, while providing effective shielding of the user.

It is another object of the present invention to provide a ballistic assault ladder which provides a quick and effective means of approaching and climbing a target area.

Lastly it is an object to provide a ballistic assault ladder which is easily carried, while allowing to be shielded effectively and relatively unencumbered so as to carry a weapon or other instrument.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
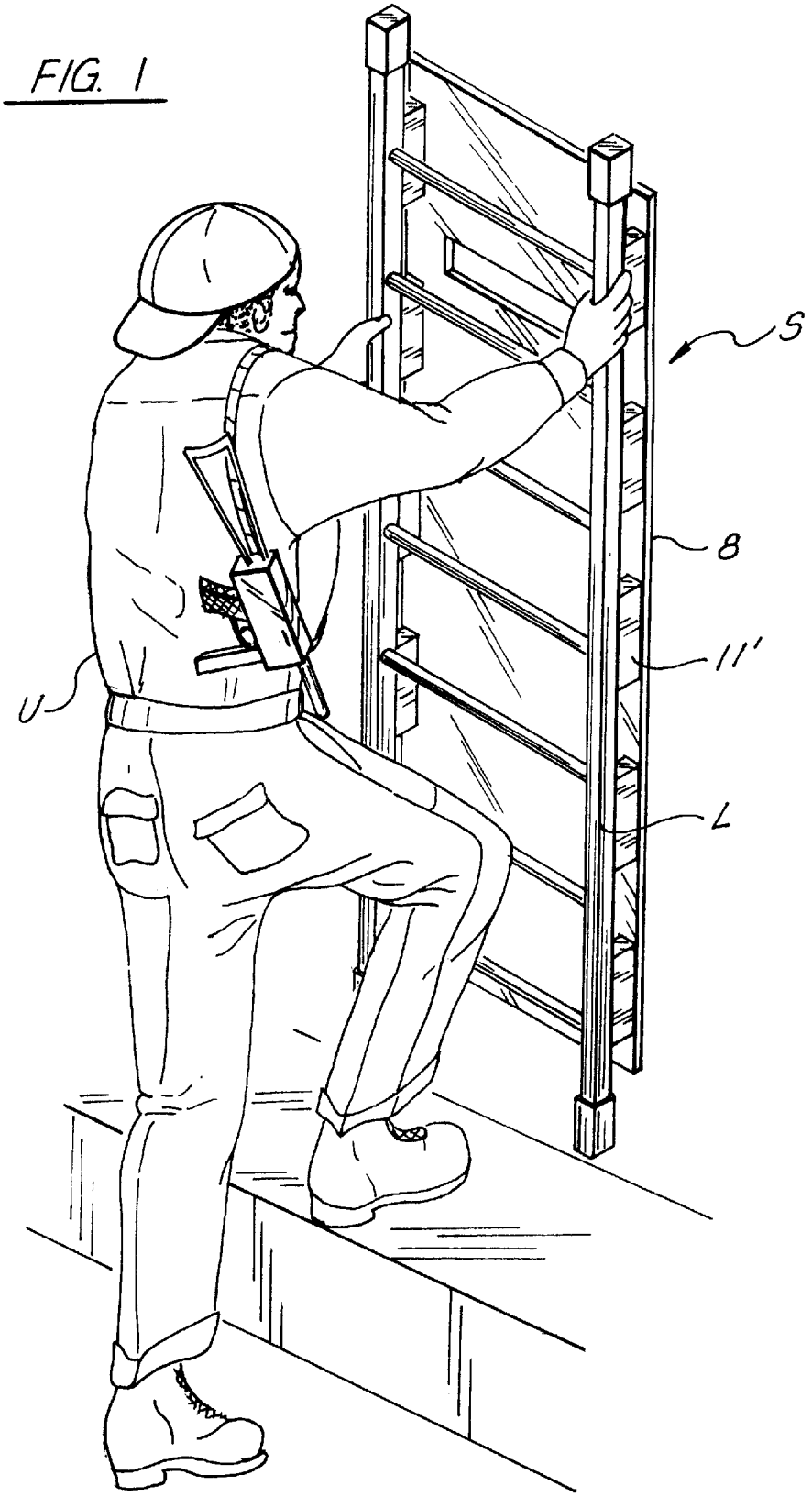
FIG. 1 illustrates a side, isometric view of the preferred embodiment of the present invention in use by a law enforcement official.
Figure 2:
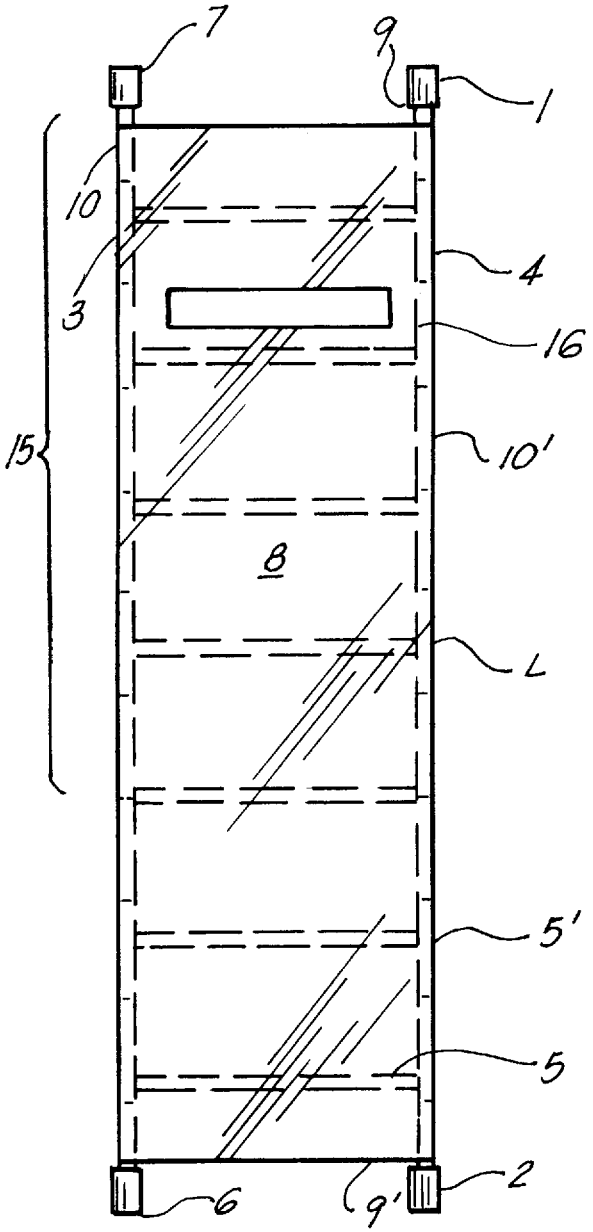
FIG. 2 illustrates a frontal view of the preferred embodiment of the invention of FIG. 1, illustrating the shield member of the system, with the ladder it is mounted to illustrated in phantom.
Figure 3:
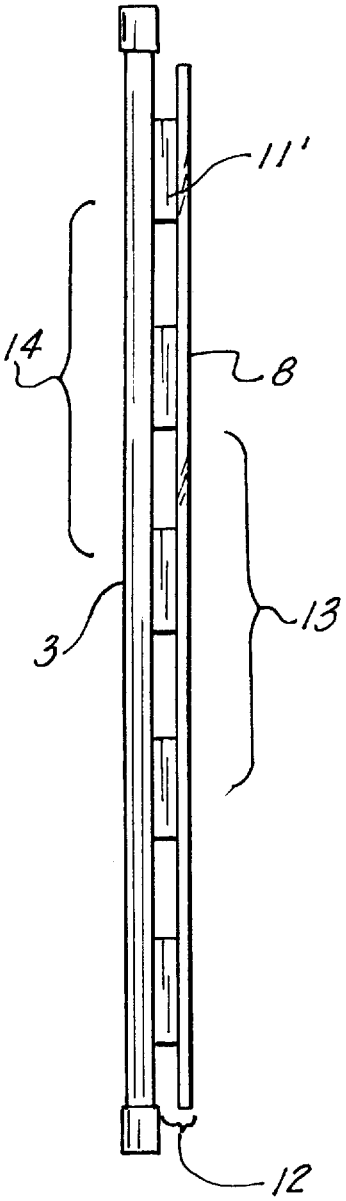
FIG. 3 is a side view of the preferred embodiment of the invention of FIG. 1, illustrating the spacer juxtaposed between the shield member and the ladder.
Figure 4:
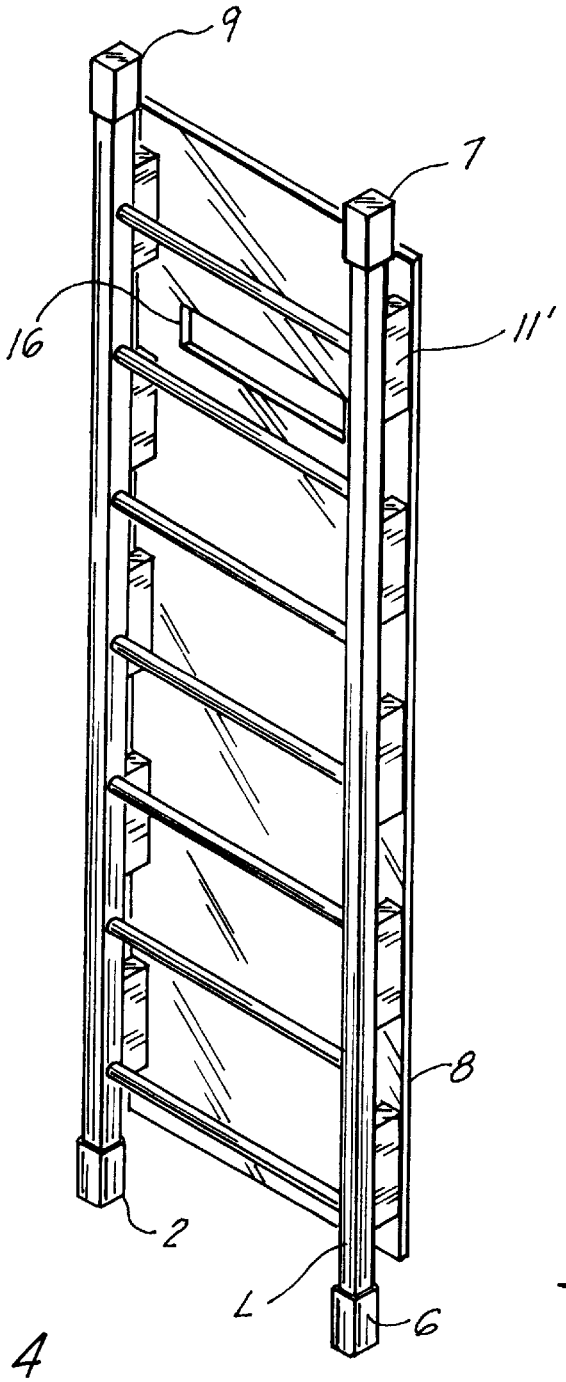
FIG. 4 is an isometric view of the invention of FIG. 1, illustrating another view of the spacer juxtaposed between the shield member and the ladder, and the position of the padded ladder ends and portal mounted in the shield.

Referring to FIGS. 2, 3, 4, and 5B, of the drawings, the ladder L of the present invention includes first 1 and second ends 2, having first 3 and second 4, generally longitudinally aligned support members, each of said support members having a first 10 and second 11 side edges, and a plurality of generally aligned rungs 5, 5' laterally situated between each support member, the entire structure forming front 13 and rear 14 faces, respectively. Situated at each end of the first and second support members area are end pads 6, 7 respectively. The pads may be fabricated of, for example, urethane foam, cloth, rubber, vinyl, or other material. An exemplary length of ladder may comprise, for example, five feet, but the actual size is highly flexible depending upon the application, size of the user, etc.

Mounted to the front face 13 of the ladder, along the second 11 side edge of each of the support members 3,4 is spacer 11', configured to support a ballistic shield 8 having a portal 16 thereupon along its upper section 15 for viewing therethrough by the occupant. Ideally, the portal should be formed of a material resistant to projectiles and the like, while being at least somewhat transparent such as, for example, KEVLAR, SPECTRA or the like. As shown, the spacer acts to mount the shield to the ladder, while spacing 12 same from the ladder a distance to allow the passage of the users middle foot upon the rungs of the ladder, and not interfering with the users utilization of same.

As indicated, the spacer, forming the spacing means of the system, is juxtaposed between the ballistic shield and the second face of the ladder, the spacing means having first and second edges, respectively.

Figure 5A:
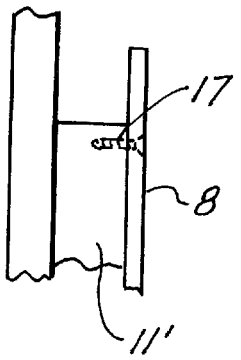
FIG. 5A is a side, close-up view of an exemplary mounting of the shield to the spacer member of FIG. 1, illustrating the utilization of a threaded screw therefore in phantom.
Figure 5B:
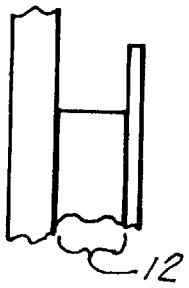
FIG. 5B is is a side, close-up view of an exemplary mounting of the shield to the spacer member of FIG. 1.

As discussed, the first edge of the spacer is in communication with said second face of said ladder, while the second edge of the spacer means further including connection means for engaging said ballistic shield such as, for example, a slot formed longitudinally along the length of said spacer. Referring to FIG. 5A, the shield 8 may be mounted to the spacer 11' by, for example, screws 17 or other threaded connector, or, for a fabric-type ballistic shield, via tongue and groove arrangement formed on the outer face of the spacer, by a rod/aperture arrangement, wherein the rod would pass through a sleeve along each side of the shield, which is in turn slid into a rod accepting conduit formed along the spacer, rivets, snaps, zipper, or other removable or non-removable attachment.

Thus, the connection means for engaging said second edge of said spacing means to said ballistic shield may form a releasable connection such as, for example, a plurality of spaced threaded connectors such as screw, nut, bolts, or the like, a zipper, hook and loop connector such as VELCRO or the like.

The ballistic shield has a width and a length generally corresponding to the front face of the ladder and the ballistic shield is preferably fabricated of a material having a strength sufficient to prevent the passage of a projectile, such as small arms fire, rifle fire, and flak therethrough, such as, for example, level IIIA ballistic material, as shown earlier.

Referring to FIG. 1, an exemplary method of use of the present system by a user U approaching a hostile area could include, for example, the following steps:

a. providing a ladder having first and second support members, each of the support members having first and second ends, inner and outer sidewalls, a first face and a second face, respectively, the ladder further including and a plurality of laterally situated rungs juxtaposed between said inner sidewalls of said first and second support members, b. providing a ballistic shield 8 having a width and a length, said ballistic shield fabricated of a material having a strength sufficient to prevent the passage of a projectile therethrough;

c. providing spacing means juxtaposed between the ballistic shield and said second face of said ladder, said spacing means having first and second edges, respectively, said first edge of said spacing means in communication with said second face of said ladder, said second edge of said spacing means further including connection means for engaging said ballistic shield.

d. grasping at least one of the rungs of said ladder through the first face of said ladder, lifting said ladder;

e. holding said ladder such that said ballistic shield is juxtaposed the user and said hostile area;

f. upon reaching any raised obstacles, said user utilizing said ladder to climb there over.

Alternative embodiments of the system of the present invention may include, for example, that the connection means of step "c" is releasable, and wherein there is further provided a step "g" the additional step of inspecting the shield for damage, and further including the step "h" of replacing a shield if is damaged by disengaging the releasable connection means and replacing said ballistic shield with a new shield, and re-engaging same to said ladder via the releasable connection means.

As indicated in the discussion of the preferred apparatus of the invention, the ballistic shield of step "b" of the above method may further comprise a portal, after step "e" there may be further included the step of the user viewing the hostile area through shield as it approaches same.

In using the ladder and pads in the present system, in step "a" each of the first and second ends of the first and second support members, respectively, may further comprise first and second pad members affixed thereto, respectively, and wherein it is further included in step "f" the additional step of placing said first pad against the ground, the second step of placing said second pad against the obstacle, and the third step of scaling said ladder.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense; particularly, it is noted that the ladder may be of varying heights or number of rungs, and the shield may be spaced at varying distances from the ladder via spacers, depending upon the application. Further, it is noted that there may or may not be included a shield, as desired, and the shield can vary in size, configuration, and material, depending upon application.

What is claimed is:

1. A device for protecting a user from projectiles, comprising:

a ladder having a longitudinal axis and first and second support members, each of said support members having first and second ends, a first face and a second face, respectively, said ladder further including a plurality of laterally situated rungs having a length juxtaposed between said first and second support members, said support members having a length greater than said length of said rungs;

a ballistic shield having a width, a length, and a longitudinal axis, said ballistic shield having a portal formed therein, said ballistic shield fabricated of a material having a strength sufficient to prevent the passage of a projectile therethrough;

spacing means juxtaposed between said ballistic shield and said second face of said ladder, said spacing means having first and second edges, respectively, said first edge of said spacing means in communication with said second face of said ladder, said second edge of said spacing means further including connection means for engaging said ballistic shield, said spacing means configured to space said ballistic shield from said rungs of said ladder in generally longitudinal alignment with said ladder, as well as a sufficient distance so as to allow a user to climb said rungs and utilized said ladder in an unimpeded fashion.

2. The ladder of claim 1, wherein said connection means for engaging said second edge of said spacing means to said ballistic shield is releasable.

3. The ladder of claim 1, wherein said portal is fabricated of a material resistant to the penetration of a projectile therethrough.

4. The ladder of claim 3, wherein each of said first and second ends of said first and second support members, respectively, further comprise first and second pad members affixed thereto, respectively.

5. The method of a user approaching a hostile area which includes the launching of projectiles therefrom, comprising the steps of:

a. providing a ladder having a longitudinal axis, said ladder further having first and second support members, each of said support members having first and second ends, a first face and a second face, respectively, said ladder further including a plurality of laterally situated rungs having a length juxtaposed between said first and second support members, said first and second support members having a length greater than said length of said rungs, b. providing a ballistic shield having a longitudinal axis, a width and a length, said ballistic shield fabricated of a material having a strength sufficient to prevent the passage of a projectile therethrough, said ballistic shield having a portal formed therein;

c. providing spacing means juxtaposed between said ballistic shield and said second face of said ladder, said spacing Means having first and second edges, respectively, said first edge of said spacing means in communication with said second face of said ladder, said second edge of said spacing means further including connection means for engaging said ballistic shield, said spacing means configured to space said ballistic shield from said rungs of said ladder in generally longitudinal alignment with said ladder, as well as a sufficient distance so as to allow a user to climb said rungs and utilized said ladder in an unimpeded fashion;

d. grasping at least one of said rungs of said ladder through the first face of said ladder, lifting said ladder;

e. holding said ladder such that said ballistic shield is juxtaposed said user and said hostile area, and said user is able to view through said portal;

f. upon reaching any raised obstacles which impede the passage of said user there over, said user leaning said ballistic shield against said obstacle and utilizing said ladder to climb over said obstacle.

6. The method of claim 5, wherein said connection means in step "c" is releasable, and wherein there is further provided a step "g" of inspecting said shield for damage, and there is further included a step "h" of replacing a shield if it is damaged by disengaging said connection means and replacing said ballistic shield with a new shield.

7. The method of claim 5, wherein in step "a" each of said first and second ends of said first and second support members, respectively, further comprise first and second pad members affixed thereto, respectively, and wherein it is further included in step "f" the additional step of placing said first pad against the ground, the second step of placing said second pad against the obstacle, and the third step of scaling said ladder.

* * * * *